United States Patent [19]

Dornbusch et al.

[11] Patent Number: 4,467,923

[45] Date of Patent: Aug. 28, 1984

[54] DIVIDABLE DISPLAY AND SHIPPING CONTAINER

[75] Inventors: Arthur H. Dornbusch; Robert W. Blaut, both of Cincinnati, Ohio

[73] Assignee: The Procter & Gamble Company, Cincinnati, Ohio

[21] Appl. No.: 392,833

[22] Filed: Jun. 28, 1982

[51] Int. Cl.[3] ..... B65D 5/54

[52] U.S. Cl. ..... 206/602; 206/606; 206/627; 206/633; 206/192; 229/15; 229/27; 229/33; 229/36

[58] Field of Search ..... 206/602, 606, 620, 627, 206/633, 604, 193, 192; 229/15, 27, 43, 33, 36, 32

[56] References Cited

U.S. PATENT DOCUMENTS

| | | | |
|---|---|---|---|
| 2,307,720 | 1/1943 | Ringler | 229/43 |
| 2,551,679 | 5/1951 | Johnson | 229/52 |
| 2,596,331 | 5/1952 | Ferguson | 229/27 |
| 2,684,178 | 7/1954 | Keeler | 206/192 |
| 2,697,544 | 12/1954 | Morand | 229/15 |
| 2,864,548 | 12/1958 | Zastrow | 206/602 |
| 3,135,457 | 6/1964 | Risucci | 229/51 |
| 3,542,192 | 11/1970 | Steck | 206/65 |
| 3,554,402 | 1/1971 | Lock | 206/193 |
| 3,677,458 | 7/1972 | Gosling | 229/27 |
| 4,082,215 | 4/1978 | Eichenauer | 229/36 |
| 4,256,223 | 3/1981 | Pawlowski | 206/192 |

*Primary Examiner*—Steven M. Pollard
*Assistant Examiner*—Bryon Gehman
*Attorney, Agent, or Firm*—Richard C. Witte; John V. Gorman; Ronald J. Snyder

[57] ABSTRACT

A shipping container which after initial delivery is adapted to be divided into two subcontainers, each of which can thereafter be shipped to another location, stored or used for display purposes. A pair of retaining members extend vertically and in face-to-face relation into the container from a closure, each being integrally attached to one of a pair of opposed flaps of the closure and each bearing securing tabs, one at each end. The securing tabs extend through slots in the side walls of the container and are folded 90° and glued so the inner surface portion of each is adhesively attached to an outer surface portion of a side wall adjacent the slots. The balance of the container material is adapted to be separated along a plane interconnecting the slots.

10 Claims, 11 Drawing Figures

DIVIDABLE DISPLAY AND SHIPPING CONTAINER

TECHNICAL FIELD

This invention relates generally to shipping containers formed of fiberboard or the like and assembled from unitary blanks. More particularly, this invention relates to shipping containers that are readily dividable into two subcontainers that can be used for shipping and display purposes.

BACKGROUND ART

It is usually desirable to ship a relatively large quantity of product from a producer's factory or warehouse to keep the unit shipping and handling costs to a minimum. However smaller stores or retail outlets may find it undesirable to handle such quantities or to display a portion of such a shipment and store the remainder. As a consequence, potential sales outlets and sales may be lost. To avoid such a loss, producers may employ a variety of smaller containers or inserts to allow a chain store distributor to break the original shipping container open and distribute the contents in the smaller containers to the retail stores. Inserts or small containers for use inside larger containers are expensive to use and serve to reduce the profit of either the producer or the retailer.

An alternative to inserts is to design and employ a one-piece shipping container that can be readily divided into two subcontainers for re-shipping or for display purposes. One example of this type of container is disclosed in U.S. Pat. No. 3,135,457 issued to E. J. Risucci. The final assembled container, shown in FIG. 2 of Risucci, shows essentially two identical containers that are merely connected by the accordion flap 13 which has a tear line 14 to separate the two containers. This embodiment is not easily loaded initially and the accordian flap makes it difficult to ship the box in a squared configuration. In addition the subcontainers do not facilitate product display or access for price marking.

A more practical container is that disclosed in U.S. Pat. No. 2,551,679 issued to E. F. Johnson on May 8, 1951. After erection, loading and sealing, the Johnson container includes a pair of overlapping, full depth, handle equipped partitions on each box half, which divide the product contained therein, and appropriate printed lines indicating the path along which dividing cuts are made on each side wall to sever the container into two subcontainers. The subcontainers are not of a display type nor do they facilitate price marking. In addition, another primary disadvantage of the Johnson-style container is that after it is divided into the two subcontainers, there is no secured panel where the common wall had been, to retain the product contained in the subcontainers. Therefore, in order to use these subcontainers for reshipping the user would need to secure the partition panels 25 in the closed position to cover the subcontainer's opening. This requires additional handling costs and may still make the use of such dividable container unattractive.

Other approaches to the solution of the problem are shown in U.S. Pat. Nos. 2,596,331 and 2,697,544 issued, respectively, on May 13, 1952 and Dec. 21, 1954 to K. C. Ferguson and E. Morand. Each of these references provides a container which is severable into sub-containers in use. However, each utilizes an expensive blank and results in subcontainers which are completely closed and therefore provide no opportunity to display the product or to price mark it.

Another container adapted to be split in two parts in use is taught in U.S. Pat. No. 3,542,192, which issued to C. O. Steck on Nov. 24, 1970. The Steck container permits manual separation of the top portion from the lower portion, which is then used as an open-top display tray to expose the contents and facilitate price marking. This structure does not, however, permit the original container to be divided into sub-portions for retail outlets nor is it adapted, following opening, to be shipped from one location to another.

DISCLOSURE OF THE INVENTION

It is an object of the present invention to provide a one-piece shipping container that can be erected and loaded with conventional equipment and that is readily dividable into two subcontainers.

It is a further object of the invention to provide for two subcontainers that are capable of being handled and shipped without the need for additional packing or repacking of the product or the container.

It is an additional object of the present invention to provide subcontainers which can be employed for display purposes, for use as convenient carrying containers for the purchase of a quantity of product and which permit access for price marking.

Accordingly, this invention provides for a shipping container which is adapted to be divided into two subcontainers in use and formed from a unitary blank comprising a pair of side walls and a pair of end walls integrally connected in alternating side-by-side relation. A bottom closure flap is integrally connected to each side wall and end wall along a first score line. Similarly, top closure flaps are integrally appended to the walls along a second score line opposite the first. Each of the bottom closure flaps which are attached to a side wall has a slot therethrough which runs medially from the distal end to the first score line, the slot extending partially across the height of the associated side wall. Each of the bottom closure flaps which are attached to an end wall has a full-length retaining member integrally connected to its distal end along a third score line and of a depth which is substantially smaller than the height of the side and end walls. Each retaining member has a securing tab located at each end and integrally connected along a fourth score line perpendicular to the third score line. The effective length of each tab is no greater than the distance by which the slots extend across the side walls. A line of severence on each side wall extends generally from the end of the slot therein and across the balance of the side walls in alignment with the slot.

BRIEF DESCRIPTION OF THE DRAWINGS

Further objects and advantages of the invention will become apparent from the following description and claims and from the accompanying drawings wherein:

DETAILED DESCRIPTION OF THE INVENTION

Figure 1:
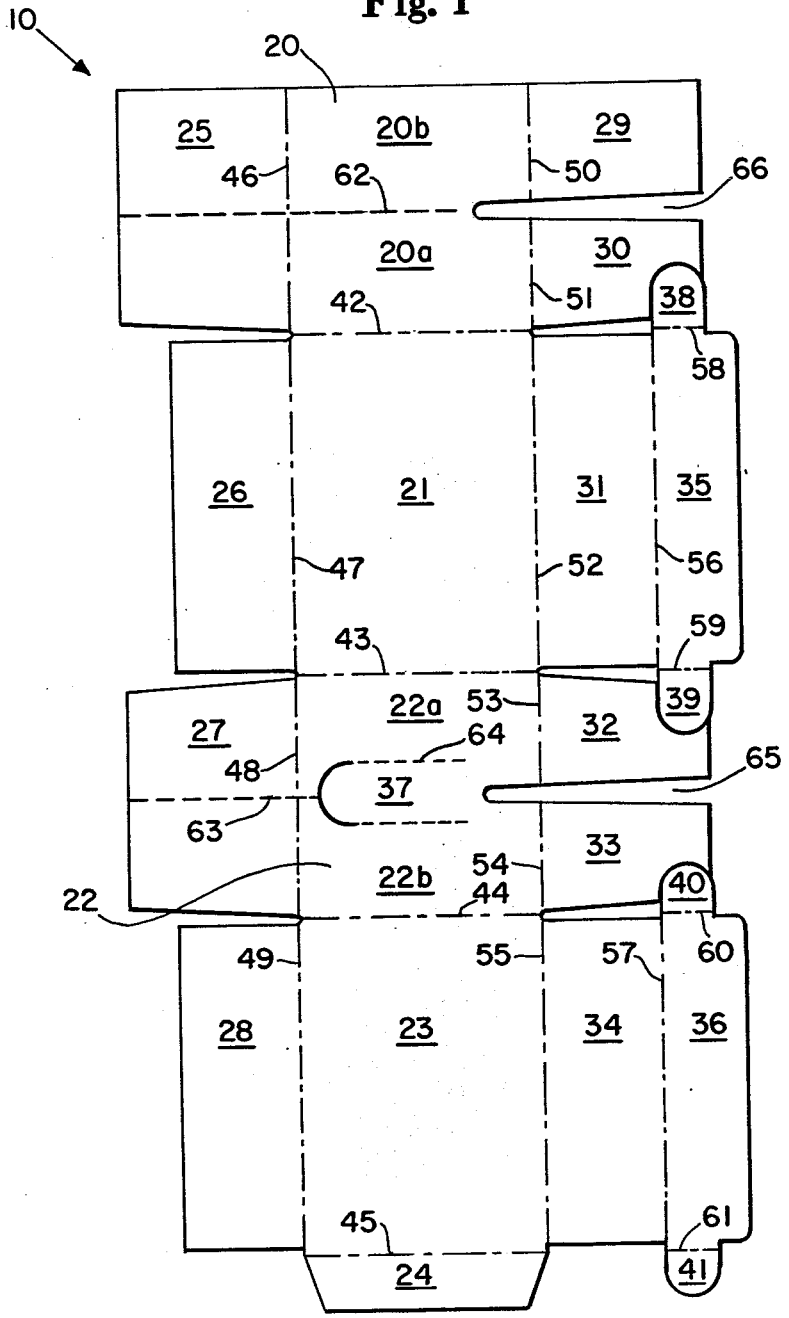
FIG. 1 is a plan view of the inner surface of a container blank illustrative of the present invention.
Figure 7:
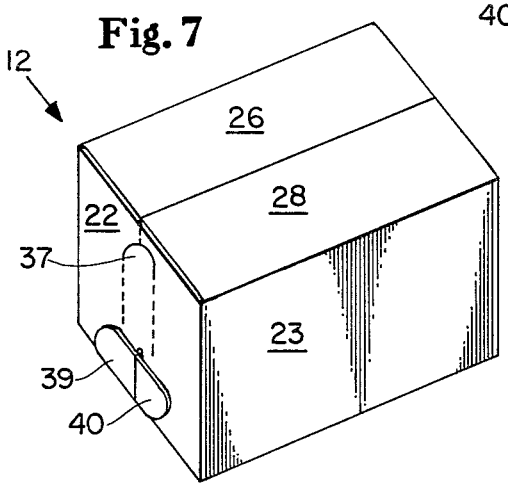
FIG. 7 is a perspective view of a sealed container erected from the blank of FIG. 1.

Referring now to the drawings in detail, wherein like numerals indicate like elements throughout the several views, a sealed container 12 of the present invention is shown in FIG. 7. The container 12 is erected from the blank 10 shown in FIG. 1. Blank 10 comprises a pair of end walls 21 and 23 and a pair of side walls 20 and 22, all of generally equal height, in alternating side by side relation, and a glue flap 24. Parallel transverse score lines 42, 43, 44 and 45 separate the various walls and glue flap.

Each of the side walls 20 and 22 and end walls 21 and 23 have top and bottom closure flaps laterally extending to the left and right, respectively. The side walls 20 and 22 have top closure flaps 25 and 27 hingedly connected at score lines 46 and 48, respectively, and adapted to form the inner coplanar sections (inner minor flaps) of the top closure. Side wall 20 is associated with a bottom closure flap comprising two sections 29 and 30 which are separated by slot 66 and these are hingedly connected at score lines 50 and 51, respectively. The slot 66 extends medially from the distal end of the flap 29, 30, across the full depth of the flap to score lines 50, 51 and extends across a minor portion of the height of the side wall 20. Side wall 22 similarly supports a bottom closure flap comprising two sections 32 and 33 which are separated by slot 65 and these are hingedly connected at score lines 53 and 54, respectively. Slot 65 also extends across the full depth of the closure flap and across a minor portion of the associated side wall 22. Bottom closure flap sections 29, 30, 32 and 33 form inner coplanar sections (the inner minor flaps) of the bottom closure.

The side walls 20 and 22 and the side wall top closure flaps 25 and 27 are each divisible into halves. Side wall 20 is divisible into halves **20*a* and 20*b* along a line of severance 62 and the terminal portion of slot 66. A line of severance, as used herein, can be a line of weakness, such as cuts, perforations, slots, or the like, or, alternatively, printed indicia denoting the path along which the container material is to be cut. Side wall 22 is divisible into halves 22*a* and 22*b* along line of severance 63; removable tear tab 37 defined by a shaped line of weakness, perforated tear line 64; and the terminal portion of slot 65. Top closure flap 25 is divisible into two halves along line of severance 62 and top closure flap 27 is divisible into two halves along line of severance 63**.

The end walls 21 and 23 have top closure flaps 26 and 28 hingedly connected at score lines 47 and 49, respectively, and adapted to form the outer coplanar sections (outer major flaps) of the top closure, and bottom closure flaps 31 and 34 hingedly connected at score lines 52 and 55, respectively, and adapted to form the outer coplanar sections (outer major flaps) of the bottom closure. The bottom closure flaps 31 and 34 further include, at their distal ends, retaining members 35 and 36 hingedly connected along score lines 56 and 57, respectively, and adapted to fold upwardly into face-to-face contact to form an upwardly extending partition. The depth of the retaining members should be substantially smaller than the height of the container walls and preferably should range between about 1/10 to about ½ of the height of the walls to provide protection for shipment and access for display and price marking when the container is subdivided in use, as will be more fully understood from subsequent description.

Each of the retaining members 35 and 36 include a securing tab at each end. Retaining member 35 includes tabs 38 and 39 hingedly connected at score lines 58 and 59, the length of which score lines is the effective length of the tabs. The tabs are adapted to extend through the terminal portions of slots 66 and 65 and to be adhered to the outer surfaces of side walls halves **20*a* and 22*a*, respectively. Retaining member 36 similarly includes tabs 40 and 41 hingedly connected at score lines 60 and 61 and adapted to extend through the terminal portions of slots 65 and 66 and to be adhered to the outer surface of side walls halves 22*b* and 20*b*, respectively. The effective lengths of the tabs 38, 39, 40 and 41 should be no greater than the distance by which the slots 65, 66 extend into the side wall 20, 22. Securing tabs 38 and 39 are somewhat deeper (from hinge line to distal end) than tabs 40 and 41** in order to facilitate separation of the tabs for gluing, an important factor bearing on the capability of handling the container automatically on simple packaging machinery.

Assembly of the container 12 from blank 10 involves a relatively straightforward series of folds. After the blank 10 is initially cut and scored, and adhesive is applied to the inner surface of the glue flap 24 and the blank 10 is then folded, as shown in FIG. 2, to form a manufacturer's joint by folding side wall 20 180° about score line 42 into face-to-face contact with end wall 21, and then end wall 23 is folded 180° about score line 44 and glue flap 24 is adhered to the outer surface of side wall 20.

Figure 2:
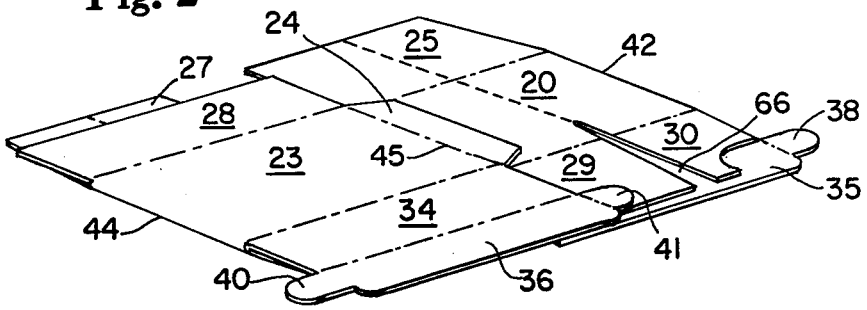
FIG. 2 is a perspective view of the blank of FIG. 1 as it is folded to form the manufacturer's joint.
Figure 3:
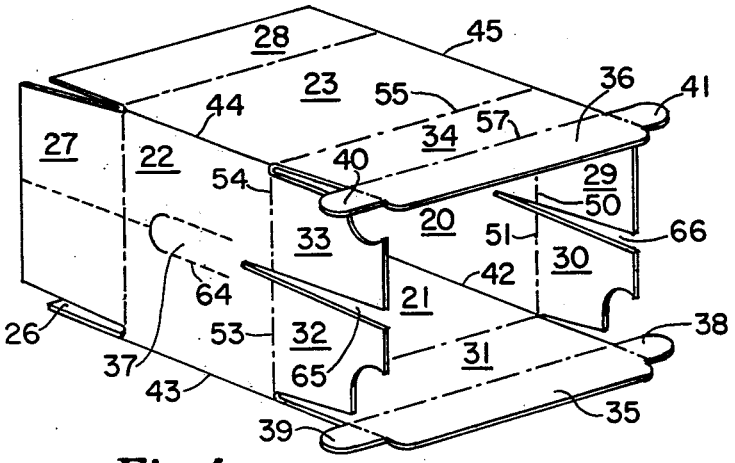
FIG. 3 is a perspective view of the blank of FIG. 1 after it is squared.

After forming the manufacturer's joint the blank 10 of FIG. 2, folded into a flat sleeve, is brought into the squared position shown in FIG. 3 by breaking score line 43 between end wall 21 and side wall 22 and score line 45 between glue flap 24 and end wall 23.

Figure 4:
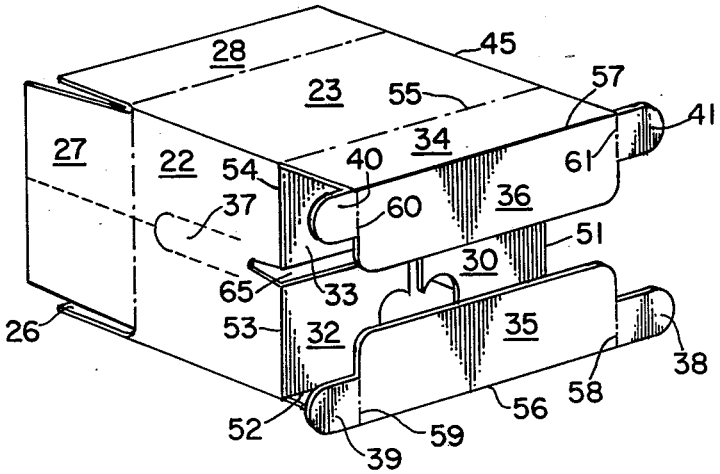
FIG. 4 is a perspective view of the blank of FIG. 1 with the retaining members folded 90° to a vertical position and the side wall bottom closure flaps folded inwardly 90°.
Figure 5:
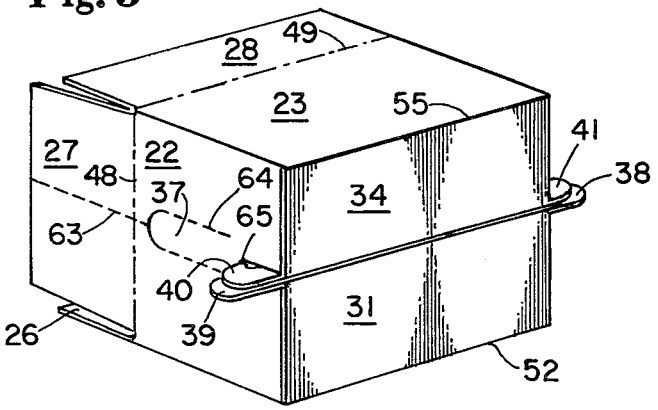
FIG. 5 is a perspective view of the blank of FIG. 1 with the end wall bottom closure flaps folded 90° to a vertical position with the securing tabs positioned into the slots in the side walls.
Figure 6:
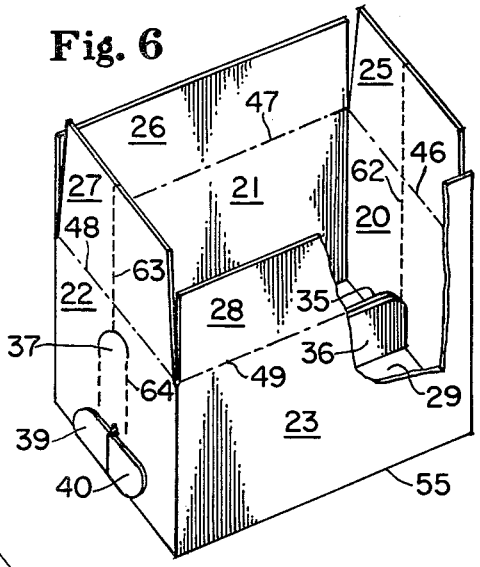
FIG. 6 is a perspective view, partially broken away, of the blank of FIG. 1 after the securing tabs have been adhered to the side walls to close the bottom and the container positioned upright ready for loading, showing the position of the retaining members.

The bottom closure of the partially erected blank 10 is then closed. First, as shown in FIG. 4, the side wall bottom closure flap sections 29, 30, 32 and 33 are folded 90° inwardly about score lines 50, 51, 53 and 54, respectively, glue is applied to their outer surfaces, and the retaining members 35 and 36 are folded 90° inwardly about score lines 56 and 57, respectively. Then, as shown in FIG. 5, the end wall bottom closure flaps 31 ad 34 are folded 90° about score lines 52 and 55, respectively, such that they become adhesively united with the underlying side wall bottom closure flap sections 29, 30, 32 and 33 and the retaining members 35 and 36 come into face-to-face contact and together fit through the slots 66 and 65, respectively. Securing tabs 38 and 39 come into face-to-face contact with securing tabs 41 and 40, respectively, and tabs 38 and 41 fit into the terminal portion of slot 66 in side wall 20 and tabs 39 and 40 fit into the terminal portion of slot 65 in side wall 22. A layer of adhesive is then applied to the outwardly facing surface (an inner surface portion of the blank) of each of the securing tabs 38, 39, 40 and 41. The longer securing tabs, 38 and 39, are then folded about score lines 58 and 59 and adhered to the outer surface of side wall halves 20*a* and 22*a*. These tabs are separated from the adjacent shorter tabs 40, 41 by applying a force against the portion of the inwardly facing tab surfaces extending beyond tabs 41 and 40, respectively. The shorter tabs 40 and 41 can then be folded about score lines 60 and 61 adhered to the outer surface of side wall halves 22*b* and 20*b*, respectively.

At this point the partially erected container 12 formed from blank 10 is turned up on its bottom and is ready for top loading. Once the container 12 is loaded the top closure is completed by folding side wall top closure flaps 25 and 27 inwardly 90° about score lines 46 and 48 to form the inner coplanar sections of the top closure, applying a layer of adhesive to the outer surface of the side wall top closure flaps 25 and 27, and then folding end wall top closure flaps 26 and 28 inwardly 90° about score lines 47 and 49 adhere them to the side wall top closure flaps 25 and 27 and form the outer coplanar sections of the top closure. The completed container 12 is shown in FIG. 7.

Figure 8:
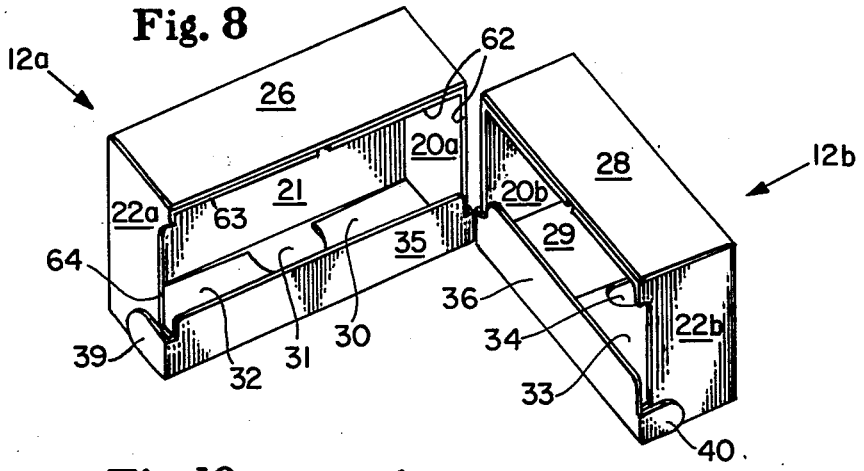
FIG. 8 is a perspective view of the container shown in FIG. 7 after severing the tear tab and tear lines to separate the container into two subcontainers.

The completed container 12 thus formed is readily divisible into two subcontainers 12*a* and 12*b*, as shown in FIG. 8. To separate the container the user fractures line of severance 64 and pulls tear tab 37 outwardly until it separates the side wall 22 down to slot 65. Thereafter the user simply severs the container material along the remaining lines of severance, line 62 along side wall 20 and on top closure flap 25 and line 63 along the top portion of side wall 22 and on top closure flap 27. The container 12 can therefore be shipped to a distributor who can, if desired, divide the product in container 12 between two retailers without the need for unpacking and repacking and without the added expense of additional, smaller shipping containers. The retaining members 35 and 36 serve to contain the product in each subcontainer 12*a* and 12*b*, respectively. In the embodiment shown in FIG. 8 the retaining members 35 and 36 are relatively small and leave a rather large opening to view the now exposed product. If the product to be shipped is shaped such that it can easily slip through this opening it may be useful to increase the depth (i.e. from the hinge line to the distal edge) of the retaining members and increase the length (between the edges perpendicular to the hinge line) of the securing tabs 38, 39, 40, and 41 accordingly. On the other hand, the large opening allows the user to employ the subcontainers 12*a* and 12*b* as display containers and facilitates price marking. The container 12 can be divided into subcontainers by the retailer and simply placed on display and the large opening provides easy access to the product by the consumer and by store clerks for price marking. In addition, the subcontainers can be sized to accommodate a limited quantity of product such that it can serve as an easy means for a consumer to purchase a quantity of product. The retaining members 35 and 36 could also be used for advertising medium.

In some instances, particularly where the packaged products are heavy, it has been found desirable to fasten a piece of reinforcing tape along and bridging the cleavage line intermediate bottom closure flaps 31, 34, thus stabilizing those flaps relative to one another and improving resistance to damage when dropped. Other variations are also possible. For example, the major and minor flaps can be reversed so that the minor flaps are located on the exterior of the formed container. This provides interior closure surfaces (the major flaps) which do not have discontinuities therein, in contrast to those found in the embodiment described above because of the cutouts made in the flap sections 30, 32 and 33 in forming securing tabs 38, 39 and 40. See FIG. 8. In a situation such as the last described variation (or in cases wherein the retaining members and securing tabs are appended to the inner minor closure flaps and the other features of the container are similarly transposed on the container) the slots in the associated closure flaps do not necessarily have to extend completely to the distal edges since in such variations only the securing tabs (not the retaining members) must pass through the slots. Consequently, the slots could extend from an intermediate point on the closure flap (spaced at least as far from the score lines of the separated closure sections as the depth of the longer of the associated securing tabs), across the score lines and partially across a minor portion of the connecting container wall. A line of severance would then necessarily interconnect that intermediate point with the distal flap edge to permit later separation of the flap sections.

Figure 11:
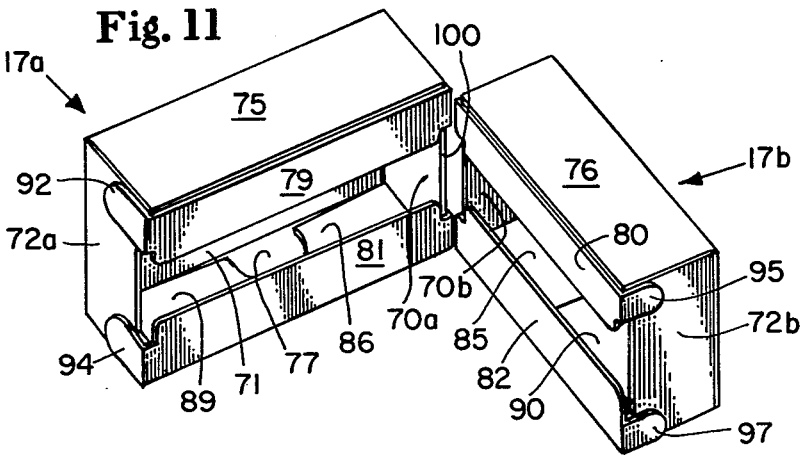
FIG. 11 is a perspective view of the container shown in FIG. 10 after severing the tear tab and tear lines to separate the container into two subcontainers.
Figure 9:
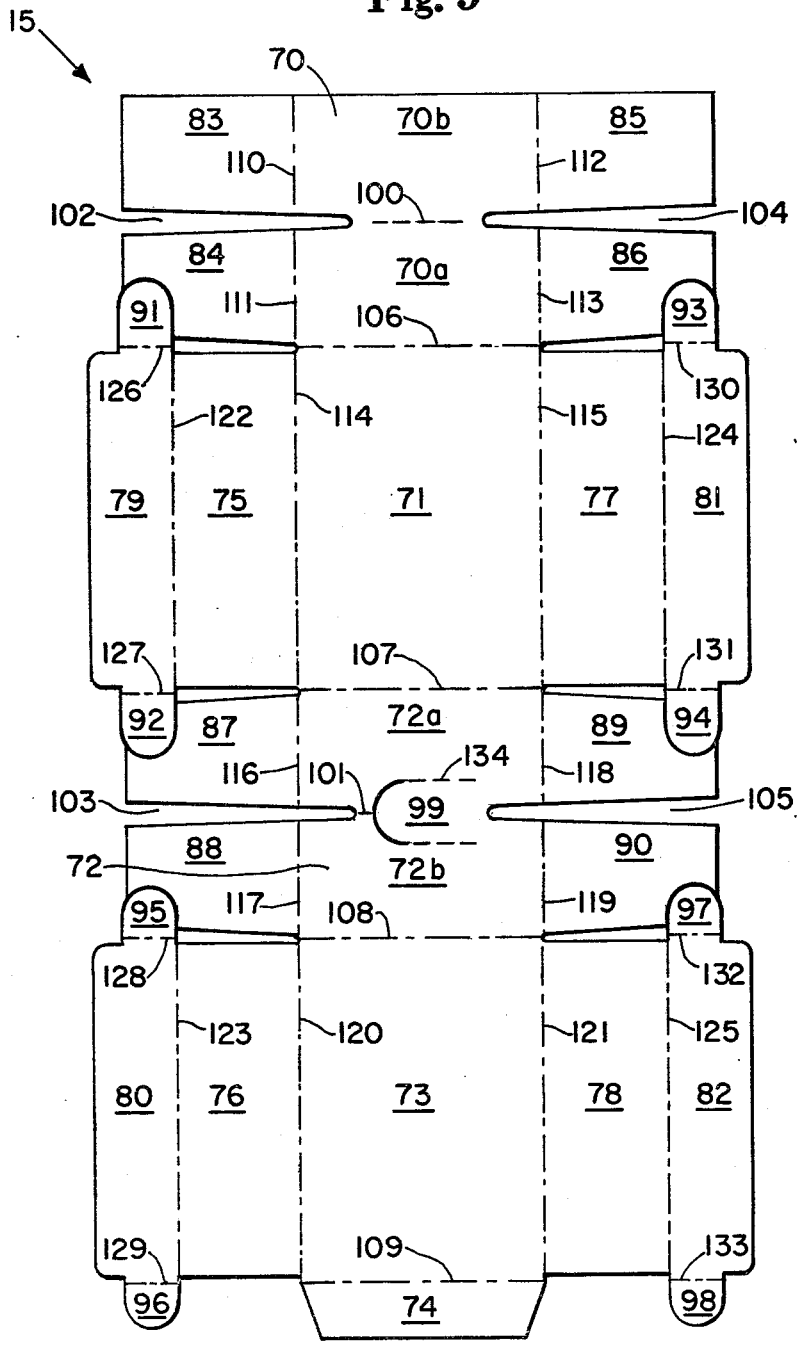
FIG. 9 is a plan view of an alternative container blank illustrative of the present invention.

The present invention can also be adapted to better serve the dual purpose of providing a more securely retained product, if one desired to ship the subcontainers, and of providing a visual opening and access to the product by consumers and clerks. To accomplish this, a container 17 having four retaining members 79, 80, 81 and 82 can be provided as shown in FIG. 11. The blank 15 to form this container 17, shown in FIG. 9, comprises a pair of end walls 71 and 73 and a pair of side walls 70 and 72 in alternating side by side relation, and a glue flap 74. Parallel transverse score lines 106, 107, 108 and 109 separate the various walls and glue flap.

Each of the side walls 70 and 72 and end walls 71 and 73 include top and bottom closure flaps laterally extending to the left and right, respectively. Side wall 70 includes a top closure flap comprising two sections 83 and 84 which are separated by slot 102 and hingedly connected at score lines 110 and 111, respectively, and a bottom closure flap comprising two sections 85 and 86 which are separated by slot 104 and hingedly connected at score lines 112 and 113, respectively. Side wall 72 similarly includes top closure flap sections 87 and 88 which are separated by slot 103 and hingedly connected at score lines 116 and 117, respectively, and bottom closure flap sections 89 and 90 which are separated by slot 105 and hingedly connected by score lines 118 and 119. Top closure flap sections 83, 84, 87 and 88 form inner coplanar sections of the top closure and bottom closure flap sections 85, 86, 89 and 90 form inner coplanar sections of the bottom closure. Each of the side walls 70 and 72 are divisible into halves. Side wall 70 is divisible into halves 70*a* and 70*b* by line of severance 100 and the lower or terminal portions of slots 102 and 104. Side wall 72 is divisible into halves 72*a* and 72*b* by line of severance 101, tear tab 99 defined by tear line 134, and the terminal portions of slots 103 and 105.

The end walls 71 and 73 include top closure flaps 75 and 76 hingedly connected at score lines 114 and 120, respectively, and adapted to form the outer coplanar sections of the top closure, and bottom closure flaps 77 and 78 hingedly connected at score lines 115 and 121, respectively, and adapted to form the outer coplanar sections of the bottom closure. The top closure flaps 75 and 76 further include retaining members 79 and 80 hingedly connected at score lines 122 and 123, respectively, and adapted to fold downwardly into face-to-face contact to form a partition. Similarly, bottom closure flaps 77 and 78 include retaining members 81 and 82 hingedly connected at score lines 124 and 125, respectively, and adapted to fold upwardly into face-to-face contact to form a partition. Each of the retaining members 79, 80, 81 and 82 include a pair of securing tabs extending outwardly from opposite sides. Retaining member 79 includes tabs 91 and 92 hingedly connected at score lines 126 and 127, and adapted to fit through slots 102 and 103 and be adhered to the outer surface of side wall halves 70*a* and 72*a*, respectively. Retaining member 80 includes tabs 95 and 96 hingedly connected at score lines 128 and 129, and adapted to fit through slots 103 and 102 and be adhered to the outer surface of side wall halves 72*b* and 70*b*, respectively. Retaining member 81 includes tabs 93 and 94 hingedly connected at score lines 130 and 131, and adapted to fit through slots 104 and 105 and be adhered to the outer surface of side wall halves 70*a* and 72*a*, respectively. Retaining member 82 includes tabs 97 and 98 hingedly connected at score lines 132 and 133, and adapted to fit through slots 105 and 104 and be adhered to side wall halves 72*b* and 70*b*, respectively. Securing tabs 91, 92, 93 and 94 are somewhat deeper than tabs 95, 96, 97 and 98 in order to facilitate separation of the tabs for gluing. The dimensional relationships mentioned previously in connection with the blank 10 bottom closure are applicable to the top and bottom closures of blank 15.

Assembly of the container 17, after initially cutting and scoring blank 15, includes applying an adhesive to the inner surface of glue flap 74 and then folding the blank 15 to form a manufacturer's joint in a manner similar to the assembly of container 12 from blank 10 as shown in FIG. 2. The side wall 70 is folded 180° about score line 106 into face-to-face contact with end wall 71, and then end wall 73 is folded 180° about score line 108 allowing the glue flap 74 to be adhered to the outer surface of side wall 70.

Figure 10:
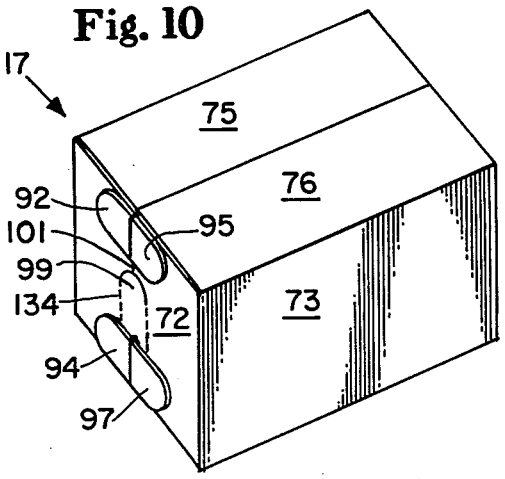
FIG. 10 is a perspective view of a sealed container erected from the blank of FIG. 9.

After forming the manufacturer's joint the blank 15 is squared into a position similar to that shown in FIG. 3 for blank 10 by breaking score lines 107 and 109. Thereafter both the bottom closure and the top closure are completed in a manner similar to that for the bottom closure of blank 10. The bottom closure is completed first in order to allow the partially erected container to be top loaded, and the top closure is completed after the container is loaded. The bottom closure is completed by folding bottom closure flap sections 85, 86, 89 and 90 inwardly 90° about score lines 112, 113, 118 and 119, respectively, coating their outer surfaces with adhesive, and folding retaining members 81 and 82 inwardly 90° about score lines 124 and 125, respectively. Then, end wall bottom closure flaps 77 and 78 are folded inwardly 90° about score lines 115 and 121, respectively, so that they become adhesively united to the underlying side wall bottom closure flap sections 85, 86, 89 and 90 and retaining members 81 and 82 and their securing tabs come into face-to-face contact and slip through slots 104 and 105. Adhesive is then applied to the outwardly facing surface of each of the securing tabs 93, 94, 97 and 98. The deeper securing tabs, 93 and 94, are then folded and adhered to side wall halves 70*a* and 72*a*, respectively, and then the shorter tabs, 97 and 98, are secured to side wall halves 72*b* and 70*b*. The procedure for forming the top closure is identical to that for completing the bottom closure. The completed container 17 is shown in FIG. 10.

As with container 12, the completed container 17 can be used to ship product or it can be readily divided into two subcontainers 17*a* and 17*b* for shipment or reshipment. The availability of two retaining members on each of the subcontainers makes it possible to use the subcontainers 17*a* and 17*b* for shipping a wider variety of products without fear of loss or damage to the product. Also the retaining members can be sized to provide as large or as small an access opening between the retaining members as desired, to thereby provide a convenient display or quantity purchase container.

Having shown and described the preferred embodiment of the present invention, further adaptions of the container can be accomplished by appropriate modifications to the blank or the container by one of ordinary skill in the art without departing from the scope of the present invention. Accordingly, the scope of the present invention should be considered in terms of the following claims and is understood not to be limited to the details of structure and operation shown and described in the Specification and drawings.

I claim:

1. A shipping container which is adapted to be divided into two subcontainers in use and form from a unitary blank comprising:

(a) a pair of side walls and a pair of end walls of generally equal height integrally connected in alternating side-by-side relation;

(b) a bottom closure flap integrally connected to each side wall and each end wall along a first score line;

(c) a top closure flap integrally connected to each side wall and each end wall along a second score line opposite said first score line;

(d) each of the bottom closure flaps which are attached to a side wall having a depthwise-extending medial slot therethrough which traverses its first score line and extends partially across the associated side wall;

(e) each of the bottom closure flaps which are attached to an end wall having a full-length retaining member integrally connected to its distal end along a third score line, said retaining member having a depth which is substantially smaller than the height of said walls such that upon division of said shipping container into two subcontainers said retaining member serves to contain product packed within a subcontainer while providing substantial access to such contained product;

(f) each retaining member having a securing tab located at each end and integrally connected along a fourth score line perpendicular to the third score line of the associated retaining member, the effective length of each tab being no greater than the distance by which the slots extend across the side walls; and (g) a line of severance on each said side wall extending generally from the end of the slot therein across the balance of the side wall in alignment with said slot.

2. The shipping container of claim 1 in which the line of severance on each side wall extends through its second score line and across the full depth of the associated top closure flap.

3. The shipping container of claims 1 or 2 in which the depths of said retaining members are in the range of from about 1/10 to about ½ of the height of the walls.

4. The shipping container of claim 3 in which the securing tabs of one retaining member are of a greater depth than those of the other retaining member.

5. The shipping container of claim 4 in which at least a portion of one line of severance comprises a removable tear tab defined by a shaped line of weakness.

6. The shipping container of claim 1 in which:

(a) each of the top closure flaps attached to a side wall has a depthwise-extending slot therethrough which runs medially of the flap, across its second score line and extends partially across the height of the associated side wall, terminating at a point spaced from the slot extending from the associated bottom closure flap, and (b) each of the top closure flaps attached to an end wall has integrally connected therewith a full-length retaining member with end mounted securing tabs.

7. The shipping container of claim 6 in which the depths said retaining members are in the range of from about 1/10 to about ⅓ of the height of the walls.

8. The shipping container of claim 7 in which the securing tabs on one retaining member of each closure are of greater depth than those of the other retaining member of the closure.

9. A shipping container which is adapted to be divided into two subcontainers in use and formed from a unitary blank having an outer surface and an inner surface, said shipping container comprising:

(a) a pair of side walls and a pair of end walls of generally equal height integrally connected in alternating relation and having top and bottom closures;

(b) the bottom closure having an inner minor flap extending inwardly from each side wall and an outer major flap extending inwardly from each end wall and adhesively united to the underlying minor flaps;

(c) said inner minor flaps each being divided into two equal sections by a slot which extends across its full depth and continues vertically into the associated side wall, said slots terminating at a distance from said bottom closure which is a minor portion of the height of the walls;

(d) said outer major flaps each having a full length retaining member integrally connected to its distal end, said retaining members each having a depth which is substantially smaller than the height of the walls and bearing a securing tab located at each end;

(e) said retaining members extending into the container interior, in face-to-face relationship, through the slots in the inner minor flaps and with the securing tabs extending through the slots in the side walls, said securing tabs each being folded inwardly and the inner surface portion thereof adhesively united with the outer surface portion of a side wall adjacent the slot through which it extends, whereby upon division of said shipping container into subcontainers, said retaining members serve to contain product packed within said subcontainers while providing substantial access to such contained product; and (f) a line of severance intermediate the ends of the slots, traversing the unslotted portions of the side walls and the top closure in alignment with the slots, said line of severance being adapted to permit separation of portions of the container lying on opposite sides of said line.

10. The shipping container of claim 9 in which the depths of the retaining members are in the range of from about 1/10 to about ½ of the height of the walls.

* * * * *

UNITED STATES PATENT OFFICE
CERTIFICATE OF CORRECTION

PATENT NO. : 4,467,923

DATED : August 28, 1984

INVENTOR(S) : Arthur H. Dornbusch and Robert W. Blaut

It is certified that error appears in the above-identified patent and that said Letters Patent are hereby corrected as shown below:

Column 5, line 19, before "adhered" add ---and--- .

Column 5, line 30, before "adhere" add ---to--- .

In Claim 4, column 9, line 11, delete "a".

In Claim 9, column 10, line 12, before "said" add ---the--- .

Signed and Sealed this

*Nineteenth* Day of *February 1985*

[SEAL]

*Attest:*

DONALD J. QUIGG

*Attesting Officer* *Acting Commissioner of Patents and Trademarks*